US009903568B2

(12) United States Patent
Hayashi et al.

(10) Patent No.: US 9,903,568 B2
(45) Date of Patent: Feb. 27, 2018

(54) LIGHTING DEVICE

(71) Applicant: PANASONIC INTELLECTUAL PROPERTY MANAGEMENT CO., LTD., Osaka (JP)

(72) Inventors: Kenichirou Hayashi, Osaka (JP); Yoshimichi Enno, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/182,478

(22) Filed: Jun. 14, 2016

(65) Prior Publication Data

US 2016/0363296 A1 Dec. 15, 2016

(30) Foreign Application Priority Data

Jun. 15, 2015 (JP) ..... 2015-120363

(51) Int. Cl.

| | |
|---|---|
| ***F21V 11/00*** | (2015.01) |
| ***F21V 17/02*** | (2006.01) |
| ***F21V 29/76*** | (2015.01) |
| ***F21V 29/89*** | (2015.01) |
| ***F21S 8/00*** | (2006.01) |
| ***F21S 8/04*** | (2006.01) |

(Continued)

(52) U.S. Cl.

CPC ..... *F21V 17/02* (2013.01); *F21S 8/032* (2013.01); *F21S 8/046* (2013.01); *F21V 7/0025* (2013.01); *F21V 14/04* (2013.01); *F21V 19/0055* (2013.01); *F21V 23/008* (2013.01); *F21V 23/023* (2013.01); *F21V 29/76* (2015.01); *F21V 29/89* (2015.01); *F21Y 2101/02* (2013.01)

(58) Field of Classification Search

CPC ..... F21V 14/04; F21V 17/02; F21V 21/30; F21V 23/04; F21V 7/0083; F21V 11/04; F21V 11/06; F21V 5/007; F21V 5/04; F21Y 2103/00; F21Y 2115/10; F21Y 2103/10; F21Y 2105/10

USPC ..... 362/235

See application file for complete search history.

(56) References Cited

U.S. PATENT DOCUMENTS

| | | | | |
|---|---|---|---|---|
| 6,206,548 B1 * | 3/2001 | Lassovsky | ..... | F21S 8/026 362/217.05 |
| 6,607,289 B2 * | 8/2003 | Lassovsky | ..... | F21S 8/026 24/458 |

(Continued)

FOREIGN PATENT DOCUMENTS

| | | |
|---|---|---|
| JP | 2010-062019 A | 3/2010 |
| JP | 2011-187244 A | 9/2011 |

(Continued)

*Primary Examiner* — Thien M Le

(74) *Attorney, Agent, or Firm* — McDermott Will & Emery LLP

(57) ABSTRACT

A lighting device includes a lighting source, a case, and a light adjuster adjusting a path of light emitted from the lighting source. The light adjuster includes a first light adjustment panel, a second light adjustment panel, and a shielding panel. The first light adjustment panel is placed between the first reflection panel and the second reflection panel, and shields a part of the light emitted from the first lighting source. The second light adjustment panel is placed between the third reflection panel and the fourth reflection panel, and shields a part of the light emitted from the second lighting source.

5 Claims, 9 Drawing Sheets

(51) Int. Cl.

| | |
|---|---|
| ***F21V 7/00*** | (2006.01) |
| ***F21V 14/04*** | (2006.01) |
| ***F21V 19/00*** | (2006.01) |
| ***F21V 23/00*** | (2015.01) |
| ***F21V 23/02*** | (2006.01) |
| *F21Y 101/02* | (2006.01) |

(56) References Cited

U.S. PATENT DOCUMENTS

| | | | | |
|---|---|---|---|---|
| 7,344,278 | B2 * | 3/2008 | Paravantsos | F21S 8/04 362/224 |
| 7,490,969 | B2 * | 2/2009 | Sun | F21S 8/00 362/600 |
| 9,291,806 | B2 * | 3/2016 | Holman | G02B 19/0066 |
| 9,605,822 | B2 * | 3/2017 | Yang | F21S 9/037 |
| 2010/0053564 | A1 | 3/2010 | Itoh | |
| 2011/0204794 | A1 * | 8/2011 | Beghelli | F21S 8/081 315/152 |
| 2015/0205134 | A1 * | 7/2015 | Bailey | G02B 27/0172 345/8 |

FOREIGN PATENT DOCUMENTS

| | | | |
|---|---|---|---|
| JP | 2013-143347 | A | 7/2013 |
| JP | 2015-002157 | A | 1/2015 |

* cited by examiner

LIGHTING DEVICE

CROSS-REFERENCE TO RELATED APPLICATION

The application is based upon and claims the benefit of priority of Japanese Patent Application No. 2015-120363, filed on Jun. 15, 2015, the entire contents of which are incorporated herein by reference.

TECHNICAL FIELD

The present disclosure relates to lighting devices and particularly relates to a lighting device for emitting light to an illuminated surface of a target standing at an installation surface of the lighting device.

BACKGROUND ART

As a conventional example, a lighting device is introduced in a document 1 [JP 2015-002157 A]. The lighting device (a horizontal light) of the document 1 is installed to illuminate a wall surface (a horizontal surface) as a background in such as TV studios and stages. Examples of the horizontal light include a lower horizontal light which is installed at a floor side, and an upper horizontal light which is installed at a ceiling side. The horizontal light includes a lighting source unit, a power source unit to supply power to the lighting source unit, and a supporting unit to support the lighting source unit from the power source unit. The lighting source unit is placed with an incline posture which a predetermined angle faces upwards so that a front surface emitting the light faces toward a diagonally upward against a wall surface.

The lighting source unit includes a main body that is contained by a cover and a case which has an opening opened at a front surface. A light-emitting unit including a substrate on which plural LEDs are mounted and a reflection means are contained within the case. The plural LEDs are placed to form LED lines as lines along a horizontal direction on the substrate, and the LED lines are arranged to a top-and-bottom direction on the substrate. The reflection means includes a pair of reflection panels in the top-and-bottom direction which reflects light emitted to the top-and-bottom direction from the plural LEDs toward the opening.

Incidentally, the lighting device (horizontal light) of the document 1 is installed at either a lower place (floor side) or an upper place (ceiling side) relative to the wall surface (illuminated surface of a target). The lighting device controls a light distribution using a pair of reflection panels placed to the top-and-bottom direction of each of LED lines so that the lighting device emits light upward from the floor when being installed at the floor side and the lighting device emits light downward from the ceiling side when being installed at the ceiling surface.

However, the reflection panels of a constitution shown in the document 1 may occur an irregular illumination of the illuminated surface of the target.

SUMMARY

In view of the above insufficiency, an object of the present disclosure is to propose a lighting device capable of reducing an irregular illumination to an illuminated surface of a target.

A lighting device of an aspect in accordance with the present disclosure emits light to an illuminated surface of a target standing at an installation surface on which the lighting device is installed. The lighting device includes: a lighting source; a case accommodating the lighting source; and a light adjuster accommodated in the case and adjusting a path of light emitted from the lighting source. The lighting source includes a first lighting source and a second lighting source aligned along a predetermined direction in the case. The predetermined direction is a direction toward a second end of the case from a first end of the case, and a first end side is a side closer to the first end than the second end. The second lighting source is placed at the first end side of the first lighting source in the predetermined direction. The light adjuster includes a first reflection panel and a second reflection panel, both reflecting light emitted from the first lighting source, a third reflection panel and a fourth reflection panel, both reflecting light emitted from the second lighting source, a first light adjustment panel placed between the first reflection panel and the second reflection panel and a second light adjustment panel placed between the third reflection panel and the fourth reflection panel. A reflection surface of the first reflection panel and a reflection surface of the second reflection panel face each other in the predetermined direction. A reflection surface of the third reflection panel and a reflection surface of the fourth reflection panel face each other in the predetermined direction. The first light adjustment panel is placed between the reflection surface of the first reflection panel and the reflection surface of the second reflection panel, and shields a part of the light, which is emitted from the first lighting source to the first end side of an optical axis of the first lighting source. The second light adjustment panel is placed between the reflection surface of the third reflection panel and the reflection surface of the fourth reflection panel, and shields a part of the light, which is emitted from the second lighting source to the first end side of an optical axis of the second lighting source.

BRIEF DESCRIPTION OF THE DRAWINGS

The figures depict one or more implementation in accordance with the present teaching, by way of example only, not by way of limitations.

DETAILED DESCRIPTION

Hereinafter, a lighting device according to an embodiment of the present disclosure is described in details with reference to drawings. However, in the following embodiment, a wall surface (horizontal surface) which is a background in such as in a TV studio or a stage assumed as a target illuminated, but the target is not limited to the wall surface which is the background. Note that, unless otherwise noted in the following explanation, in FIG. 1, an X-axis is defined as a predetermined direction, one end of the X-axis is defined as a first direction X1, and the other end of the X-axis is defined as a second direction X2. Besides, an axis which is perpendicular to the X-axis is defined as a Y-axis. One end of the Y-axis is defined as a first direction Y1, and the other end of the Y-axis is defined as a second direction Y2. An axis which is perpendicular to both the X-axis and the Y-axis is defined as a Z-axis. One end of the Z-axis is defined as a first direction Z1 and the other end of the Z-axis is defined as a second direction Z2.

The lighting device 1 of the present embodiment is described referring to FIG. 1 to FIG. 9.

Figure 1:
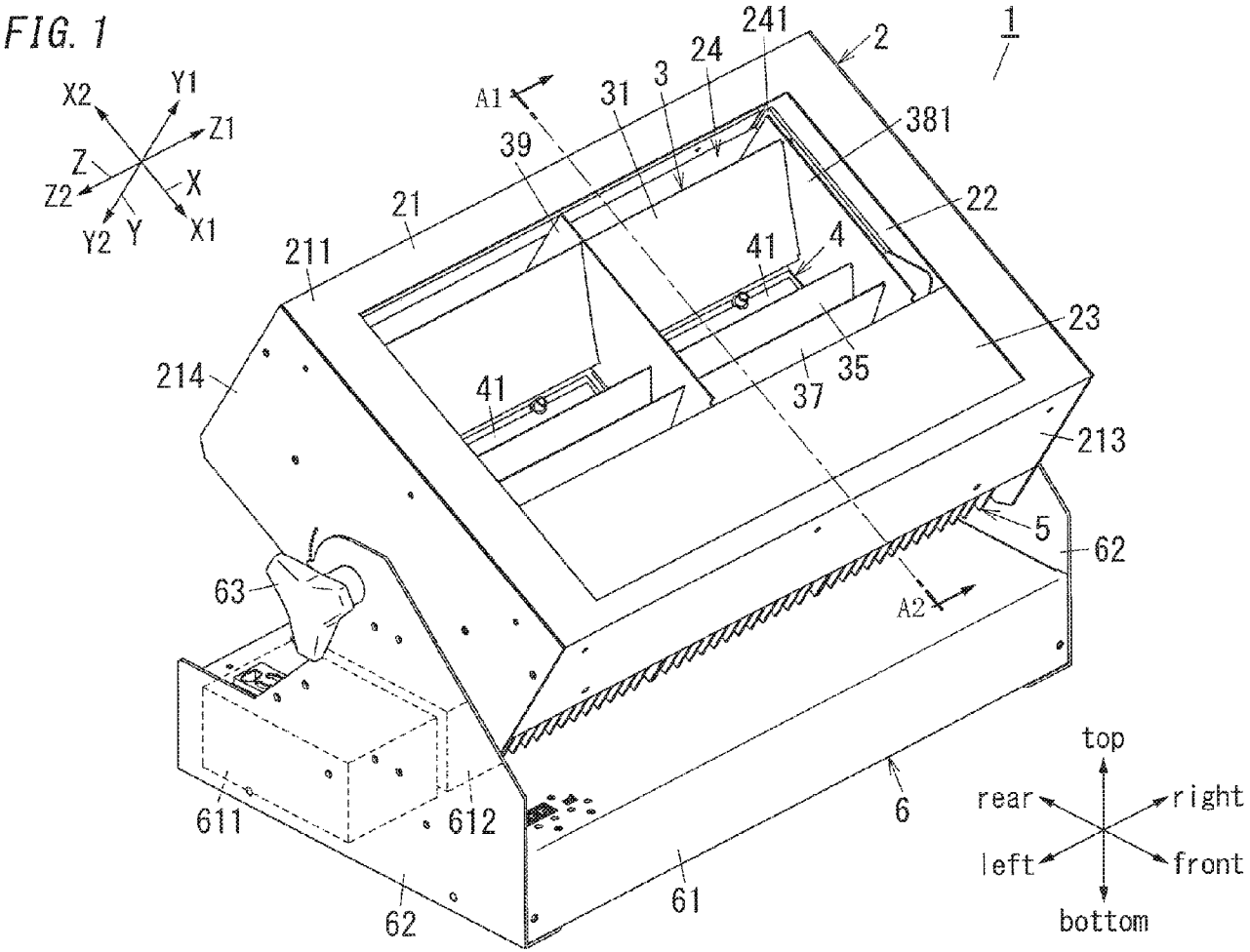
FIG. 1 is an exemplary perspective view of a lighting device of an embodiment according to the present disclosure.

As shown in FIG. 1, the lighting device 1 of the present embodiment includes a lighting source 4, a case 2 containing the lighting source 4, a light adjuster 3 contained within the case 2 and adjusting paths of light emitted from the lighting source 4, plural heat sinks 5 dissipating heat generated from the lighting source 4, and a stand holder 6 pivotally holding the case 2.

Figure 2:
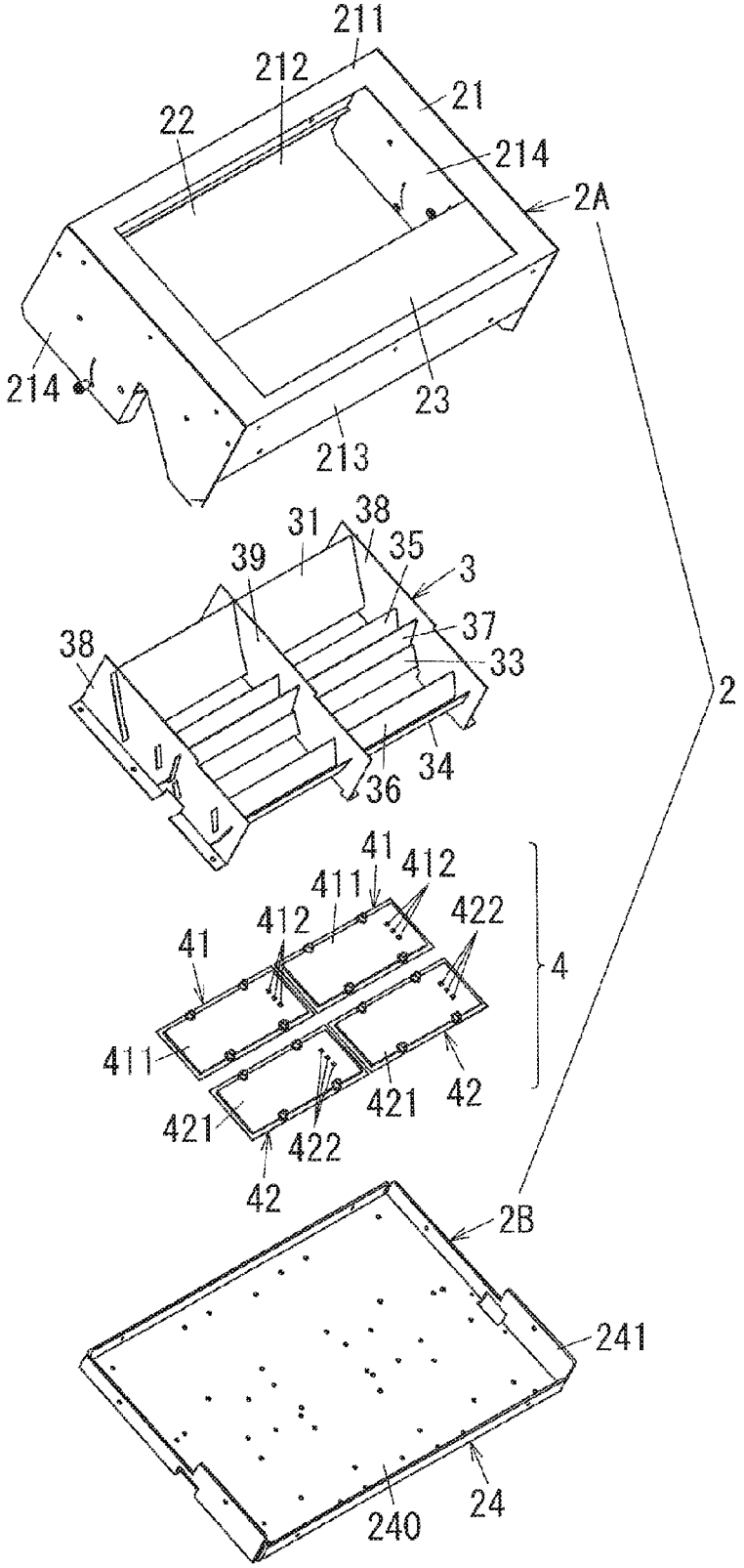
FIG. 2 is an exploded perspective view of a primary part of the lighting device.

As shown in FIG. 2, the case 2 includes a case 2A and a case 2B. The case 2A includes a top cover 21, a first panel 22, and a second panel 23. The case 2B includes a mounting panel 24. Note that, a first end of the case 2 is an end of the first direction X1 side of the X-axis. A second end of the case 2 is an end of the second direction X2 side of the X-axis. Besides, a first end side of the case 2 is a side which is closer to the first end of the case 2, in spite of an inside or outside of the case 2, than the second end of the case 2.

Figure 3:
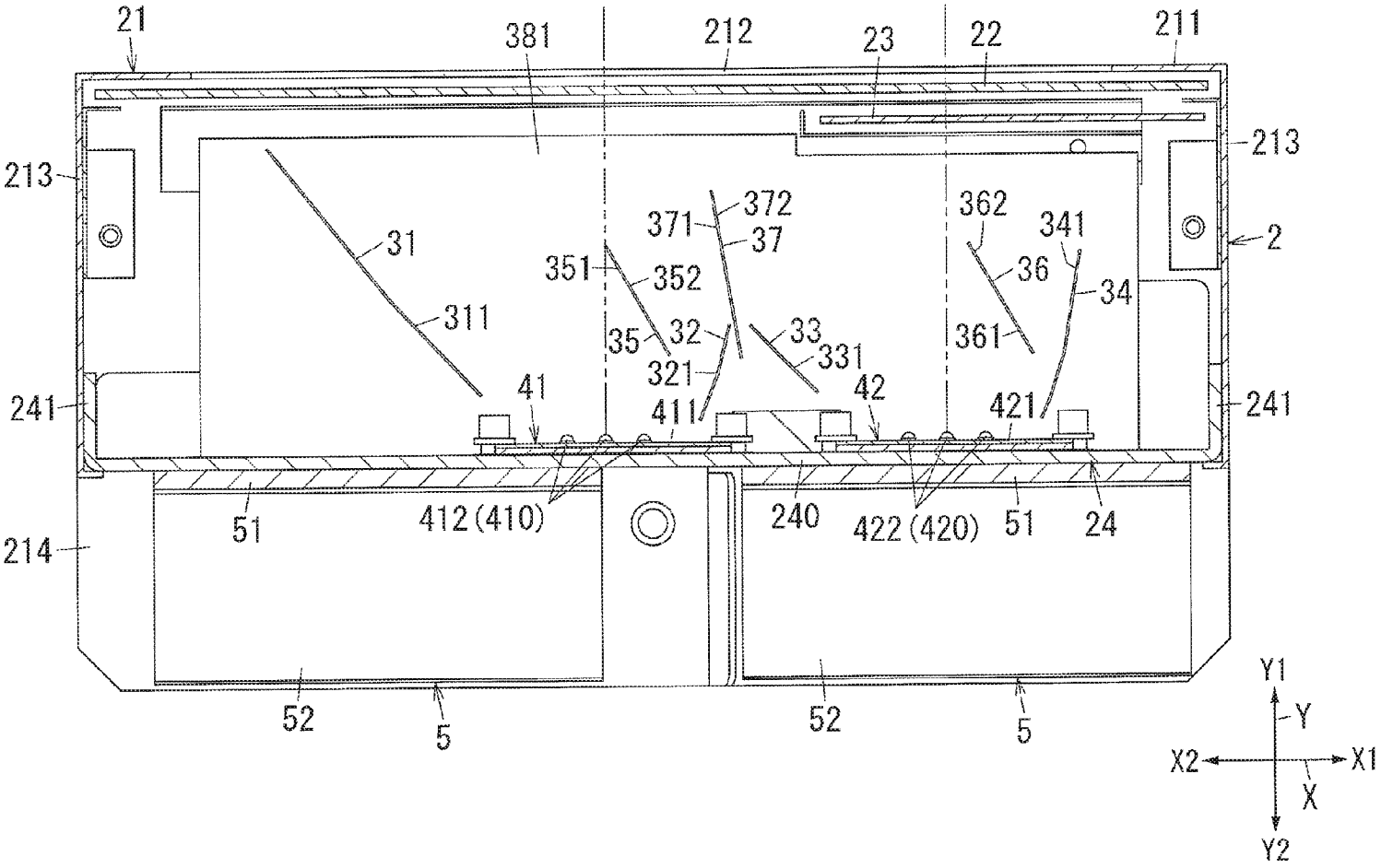
FIG. 3 is a section view seen from the A1-A2 of a primary part of the lighting device.

The top cover 21 is formed into a box shape opened on the second direction Y2 side, and includes a top surface 211 formed into a rectangle shape, and a pair of side surfaces 213 and a pair of side surfaces 214 protruded toward the second direction Y2 from a peripheral edge of the top surface 211. The pair of side surfaces 213 faces each other in the X-axis. The pair of side surfaces 214 faces each other in the Z-axis. An opening 212 is opened at the top surface 211 (refer to FIG. 3). The first panel 22 is formed into a rectangular board by a translucent material, and placed at the second direction Y2 side of the top surface 211 to cover the opening 212 of the top cover 21 (refer to FIG. 3). The second panel 23 is formed into a rectangular board colored by desired colors, and placed to partially cover the first direction X1 side of the first panel 22 from the second direction Y2 side (refer to FIG. 3). The mounting panel 24, as shown in FIG. 2 and FIG. 3, includes a bottom panel 240 is formed into a rectangular board to hold the lighting source 4 on a surface of the first direction Y1 side, and a side panel 241 protruded toward the first direction Y1 from an peripheral edge of the bottom panel 240. The mounting panel 24 is placed to cover the opening placed at the second direction Y2 side of the top cover 21, and the mounting panel 24 is assembled to the top cover 21. In other words, the side panel 241 is screwed to the side surfaces 213 and 214 of the top cover 21 with screws.

Figure 4:
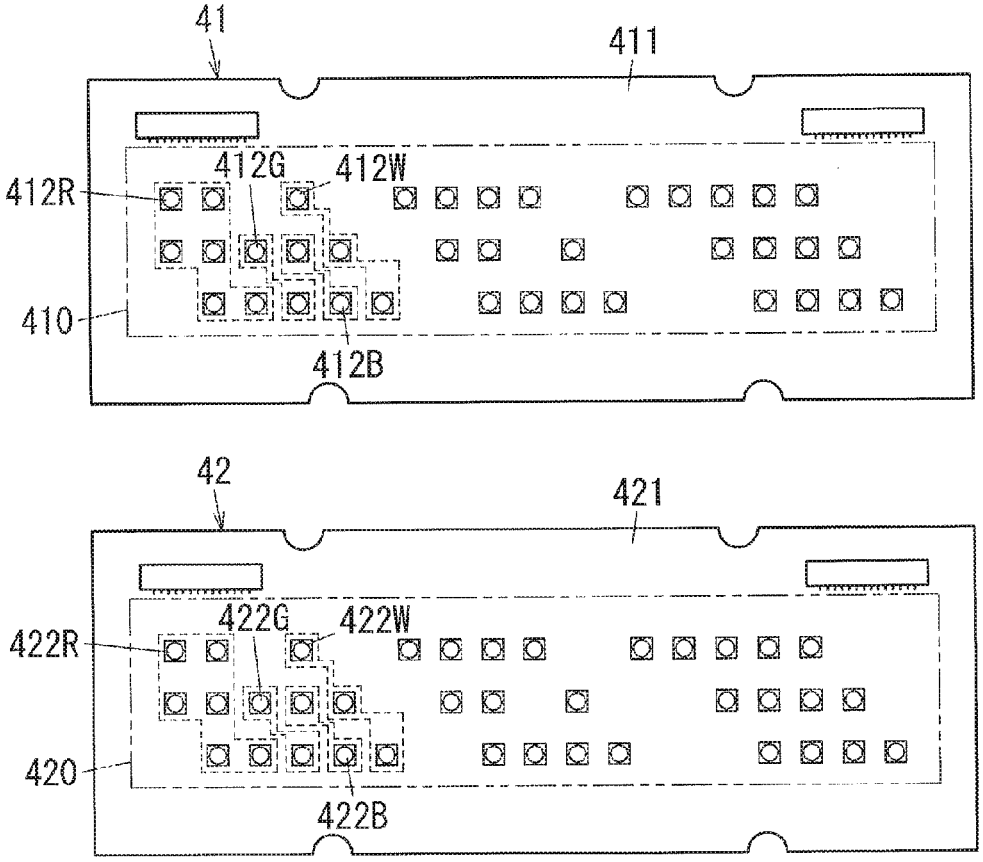
FIG. 4 is a plan view of a lighting source of the lighting device.

The lighting source 4, as shown in FIG. 2 and FIG. 4, includes two first lighting sources 41 placed in the Z-axis on a surface of the first direction Y1 side of the mounting panel 24, and two second lighting sources 42 placed in the Z-axis on the surface of the first direction X1 side of the first lighting source 41. In other words, two second lighting sources 42 are placed in a first end side of the case 2 (the first direction X1 side of the X-axis) compared with two first lighting sources 41. Each of the two first lighting sources 41 includes a lighting part 410 which has plural LEDs 412. Besides, each of the two first lighting sources 41 includes a circuit board 411 on which the lighting part 410 and the like are mounted, and is placed at the mounting panel 24 so that a side of the circuit board 411 on which the plural LEDs 412 are mounted is faced to the first panel 22 (first direction Y1). Each of the two second lighting sources 42 includes a lighting part 420 has plural LEDs 422. Besides, each of the two second lighting sources 42 includes a circuit board 421 on which the lighting part 420 and the like are mounted, and is placed at the mounting panel 24 so that the side of the circuit board 421 on which the plural LEDs 422 are mounted is faced to the first panel 22 (first direction Y1)(refer to FIG. 3). Note that, optical axes of the plural LEDs 412 and 422 are pointed to the first direction Y1. An optical axis of the first lighting source 41 indicates the optical axis of each of the plural LEDs 412. Besides, an optical axis of the second lighting source 42 indicates the optical axis of each of the plural LEDs 422. Each of the circuit boards 411 and 421 is assembled to the mounting panel 24 with screws.

As shown in FIG. 4, red LEDs 412R and 422R, green LEDs 412G and 422G, blue LEDs 412B and 422B, and white LEDs 412W and 422W are mounted on each of the circuit boards 411 and 421. Note that, the circuit boards 411 and 421 shown in FIG. 4 are one example and then the location patterns and colors of the LEDs 412 and 422 are not limited to FIG. 4.

Figure 5:
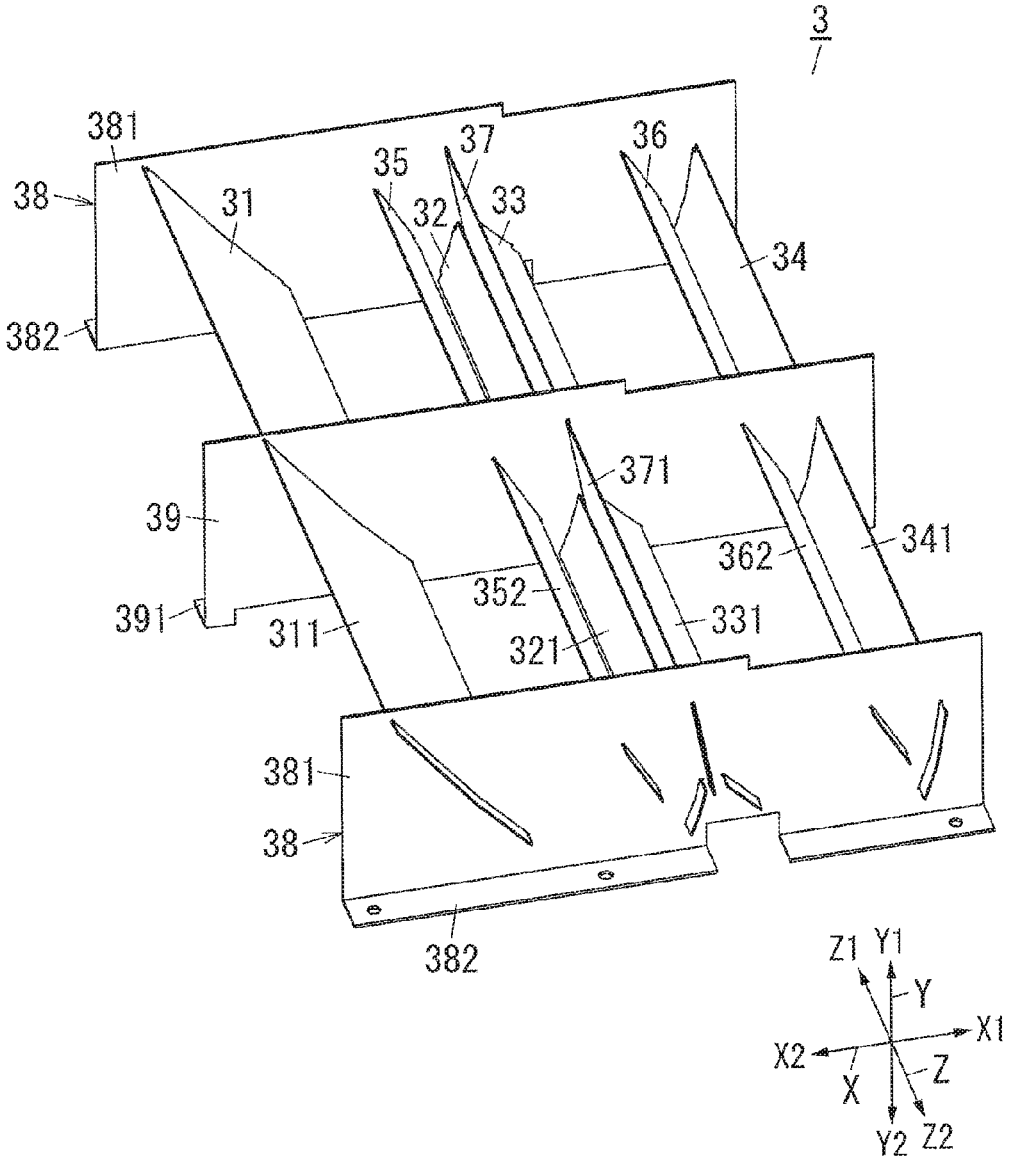
FIG. 5 is a perspective view of a primary part of the lighting device.

The light adjuster 3, as shown in FIG. 3 and FIG. 5, includes a first reflection panel 31, a second reflection panel 32, a third reflection panel 33, a fourth reflection panel 34, a first light adjustment panel 35, a second light adjustment panel 36, a shielding panel 37, a pair of side panels 38, and a middle panel 39.

Figure 6A:
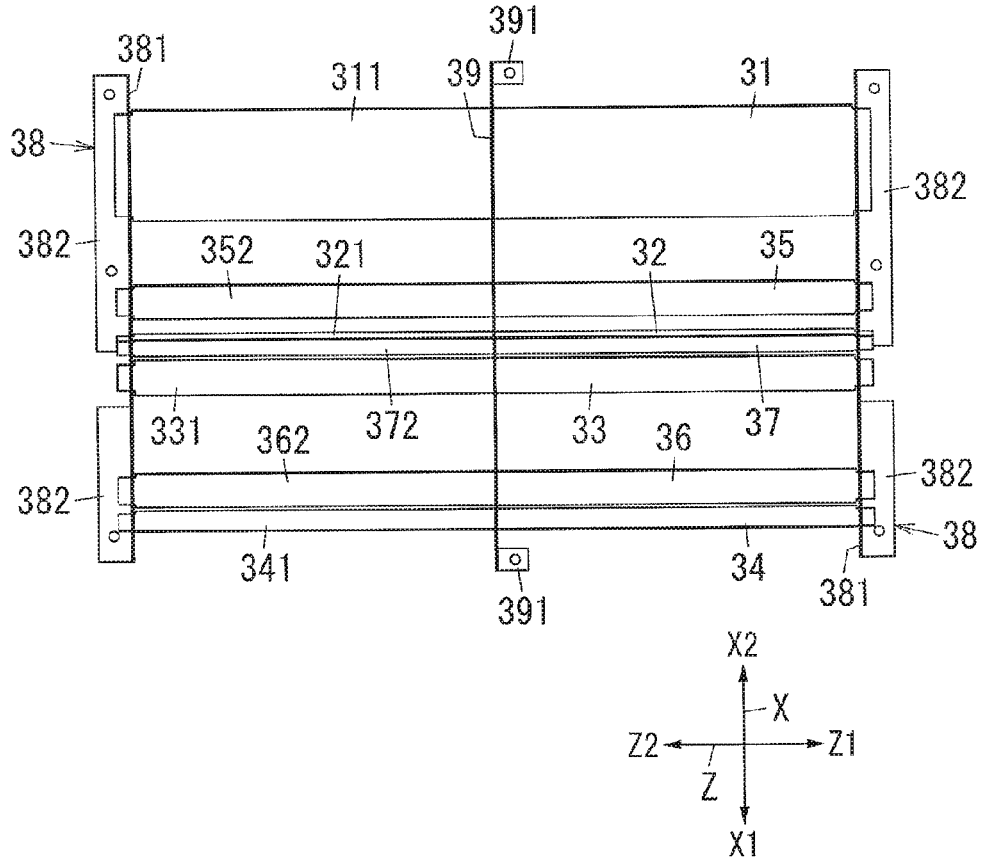
FIG. 6A is a plan view of a primary part of the lighting device.

The first reflection panel 31, as shown in FIG. 3 and FIG. 6A, is formed into a rectangular shape extended in the Z-axis direction. An end of a shorter side of the first reflection panel 31 is placed at the second direction X2 side of the first lighting source 41. The first reflection panel 31 is placed within the case 2 so that the first reflection panel 31 inclines toward the second direction X2 as a distance from the first lighting source 41 increases. The first reflection panel 31 is placed within the case 2 so that the end of the shorter side of the first reflection panel 31 is placed closer in the Y-axis direction to the first lighting source 41 compared with the other end of the shorter side of the first reflection panel 31. A reflection surface 311 of the first reflection panel 31 is configured by processing a surface of the reflection surface 311 so that the emitted light reaches, through the first panel 22, as far as possible in the second direction X2. For example, the surface of the reflection surface 311 may be processed as a mirror-processed. A configuration of the surface of the reflection surface 311 may be processed.

The second reflection panel 32 is formed into a rectangular shape extended in the Z-axis direction, and has a relatively shorter width in the Y-axis direction compared with a width of the first reflection panel 31 in the Y-axis direction. An end of a shorter side of the second reflection panel 32 is placed at the first direction X1 side of the first lighting source 41. The second reflection panel 32 is placed within the case 2 so that the second reflection panel 32 is inclined toward the first direction X1 as a distance from the first lighting source 41 increases. The second reflection panel 32 is placed within the case 2 so that the end of the shorter side of the second reflection panel 32 is placed closer in the Y-axis direction to the first lighting source 41 compared with the other end of the shorter side of the second reflection panel 32. The reflection surface 311 of the first reflection panel 31 and a reflection surface 321 of the second reflection panel 32 are placed to face to each other and reflect the light emitted from the first lighting source 41 to the first panel 22.

The third reflection panel 33 is formed into a rectangular shape extended in the Z-axis direction. An end of a shorter side of the third reflection panel 33 is placed at the second direction X2 of the second lighting source 42. The third reflection panel 33 is placed to be inclined toward the second direction X2 as a distance from the second lighting source 42 increases. The third reflection panel 33 is placed within the case 2 so that the end of the shorter side of the third reflection panel 33 is placed closer in the Y-axis direction to the second lighting source 42 compared with the other end of the shorter side of the third reflection panel 33.

The fourth reflection panel 34 is formed into a rectangular shape extended in the Z-axis direction and has a width in the Y-axis direction longer than a width of the third reflection panel 33 in the Y-axis direction. An end of a shorter side of the fourth reflection panel 34 is placed at the first direction X1 side of the second lighting source 42. The fourth reflection panel 34 is placed to be inclined toward the first direction X1 as a distance from the second lighting source 42 increases. The fourth reflection panel 34 is placed within the case 2 so that the end of the shorter side of the fourth reflection panel 34 is placed closer in the Y-axis direction to the second lighting source 42 compared with the other end of the shorter side of the four reflection panel 34. The reflection surface 331 of the third reflection panel 33 and the reflection surface 341 of the fourth reflection panel 34 are faced to each other, and the reflection surface 331 and the reflection surface 341 reflect, to the first panel 22, the light emitted from the lighting source 42. In the reflection surface 341 of the fourth reflection panel 34, for example, an angle against the reflection surface 331 of the third reflection panel 33 and a length of a width in the Y-axis direction of the reflection surface 341 of the fourth reflection panel 34 are adjusted so that the emitted light reaches, through the first panel 22, as far as possible in the second direction X2.

The first light adjustment panel 35 is formed into a rectangular shape extended in the Z-axis direction. The both surfaces of the first light adjustment panel 35 are made to shielding surfaces 351 and 352. In order to shield a part of the light emitted to the first direction X1 side of the first panel 22, the shielding surface 351 is colored with black to absorb the light as a light absorbing surface. The shielding surface 352 is colored with white to progress the higher reflectance compared with the shielding surface 351. The first light adjustment panel 35 is placed between the reflection surface 311 of the first reflection panel 31 and the reflection surface 321 of the second reflection panel 32. The first light adjustment panel 35 is placed near the first direction X1 side of the middle in the X-axis direction of the first lighting source 41. The first light adjustment panel 35 is placed within the case 2 so that the shielding surface 351 is faced up to the first lighting source 41. The first light adjustment panel 35 is placed so that an end of a shorter side of the first light adjustment panel 35 is located at the first direction Y1 side which is closer than an end in the second direction Y2 of the second reflection panel 32. The first light adjustment panel 35 is place to incline toward the second direction X2 as a distance from the first lighting source 41 increases. The first light adjustment panel 35 is placed within the case 2 so that the end of the shorter side of the first light adjustment panel 35 is placed closer in the Y-axis direction to the first lighting source 41 compared with the other end of the shorter side of the first light adjustment panel 35.

The second light adjustment panel 36 is formed into a rectangular shape extended in the Z-axis direction. The both surface of the second light adjustment panel 36 are made to shielding surfaces 361 and 362. In order to shield a part of the light emitted to the first direction X1 side of the first panel 22, the shielding surface 361 is colored with black to absorb the light as a light absorbing surface. The shielding surface 362 is colored with white to progress the higher reflectance compared with the shielding surface 361. The second light adjustment panel 36 is placed between the reflection surface 331 of the third reflection panel 33 and the reflection surface 341 of the fourth reflection panel 34. The second light adjustment panel 36 is placed near the first direction X1 side of the middle in the X-axis direction of the second lighting source 42. The second light adjustment panel 36 is placed within the case 2 so that the shielding surface 361 is faced up to the second lighting source 42. The second light adjustment panel 36 is placed so that an end of a shorter side of the second light adjustment panel 36 is located closer to the first direction Y1 side than an end in the second direction Y2 of the fourth reflection panel 34. The second light adjustment panel 36 is placed to incline toward the second direction X2 as a distance from the second lighting source 42 increases. The second light adjustment panel 36 is placed within the case 2 so that the end of the shorter side of the second light adjustment panel 36 is placed closer in the Y-axis direction to the second lighting source 42 compared with the other end of the shorter side of the second light adjustment panel 36.

The shielding panel 37 is formed into a rectangular shape extended in the Z-axis direction and placed between the second reflection panel 32 and the third reflection panel 33. The shielding panel 37 includes a shielding surface 371 shielding a part of the light emitted from the first lighting source 41 and a shielding surface 372 shielding a part of the light emitted from the second lighting source 42 at each of both surfaces respectably. The shielding surfaces 371 and 372 of the shielding panel 37 are colored with black to absorb the light as light absorbing surfaces.

Figure 6B:
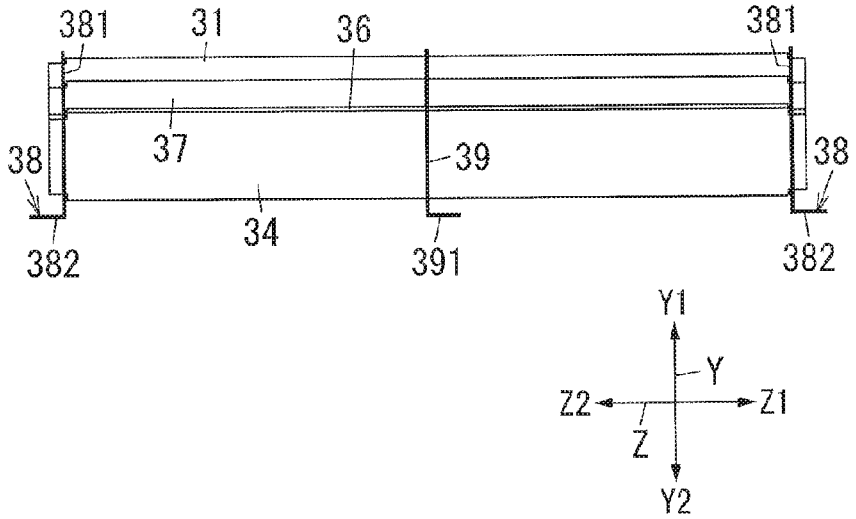
FIG. 6B is a front view of the primary part of the above lighting device.

Each of a pair of side panels 38 of the light adjuster 3, as shown in FIG. 5, FIG. 6A, and FIG. 6B, includes a pair of holding parts 381 formed into a rectangle board shape and a mounting part 382 formed for being bent perpendicular at the first direction Z1 or the second direction Z2 from the second direction Y2 side of each of the pair of holding units 381. Each of the pair of holding units 381, as shown in FIG. 3 and FIG. 5, includes slits to pass through and hold the each of both edges in the Z-axis direction of the first reflection panel 31, the second reflection panel 32, the third reflection panel 33, the fourth reflection panel 34 (refer to FIG. 1 and FIG. 2). Also, each of the pair of holding parts 381 includes slits to pass through and hold the each of both edges in the Z-axis direction of the first light adjustment panel 35, the second light adjustment panel 36, and the shielding panel 37 (refer to FIG. 1 and FIG. 2). Each of the pair of the holding parts 381 is formed into a reflection surface so that surfaces faced to each other in the Z-axis direction reflect the light emitted from the lighting source 4. The mounting part 382 is assembled to a surface of the first direction Y1 side of the mounting panel 24 with screws.

As shown in FIG. 6A and FIG. 6B, the middle panel 39 is formed into a rectangle board shape, and includes a pair of mounting chips 391 that both edges of the middle panel 39 in the X-axis direction is bent perpendicular to the first direction Z1. Each of the pair of mounting chips 391 is assembled to a surface of the first direction Y1 side of the mounting panel 24 with screws. The middle panel 39 is placed between two first lighting sources 41 along to the Z-axis direction and between two second lighting sources 42 along to the Z-axis direction. The both surfaces of the middle panel 39 are formed into reflection surfaces. The middle panel 39 has slits to pass through the first reflection panel 31, the second reflection panel 32, the third reflection panel 33, the fourth reflection panel 34, the first light adjustment panel 35, the second light adjustment panel 36, and the shielding panel 37.

Each of plural heat sinks 5, as shown in FIG. 3, includes a base 51 formed into a rectangle board shape by a metal such as an aluminum, and plural radiating fins 52 formed into a rectangle board shape at a surface of the second direction Y2 side of the base 51. When the base 51 is mounted to the surface of the second direction Y2 side of the mounting panel 24, each of the plural heat sinks 5 dissipates heat generated from the lighting source 4.

The stand holder 6, as shown in FIG. 1, includes a box 61 containing such as a power source 611 and a controller 612, and a pair of supporting panels 62. The power source 611 converts from electrical power supplied from a commercial power supply to electrical power for supplying to the lighting source 4. The controller 612 dims and arranges colors by adjusting electrical power supplying to the LEDs 412 and 422. Each of the pair of supporting panels 62 is connected to the both edges of the box 61 in the Z-axis direction and holds the case 2 being able to change an angle of the case 2 with knob bolts 63.

Note that, when the lighting device 1 is installed at a floor 101, front, rear, left, right, top, and bottom are defined in FIG. 1. The Z-axis direction shown in FIG. 1 is defined as the right-left direction, the first direction Z1 points to the right, and the second direction Z2 points to the left. Besides, a top-and-bottom direction and a front-and-rear directions are defined when the lighting device 1 is installed at the floor 101 in FIG. 7 to FIG. 9.

Figure 7:
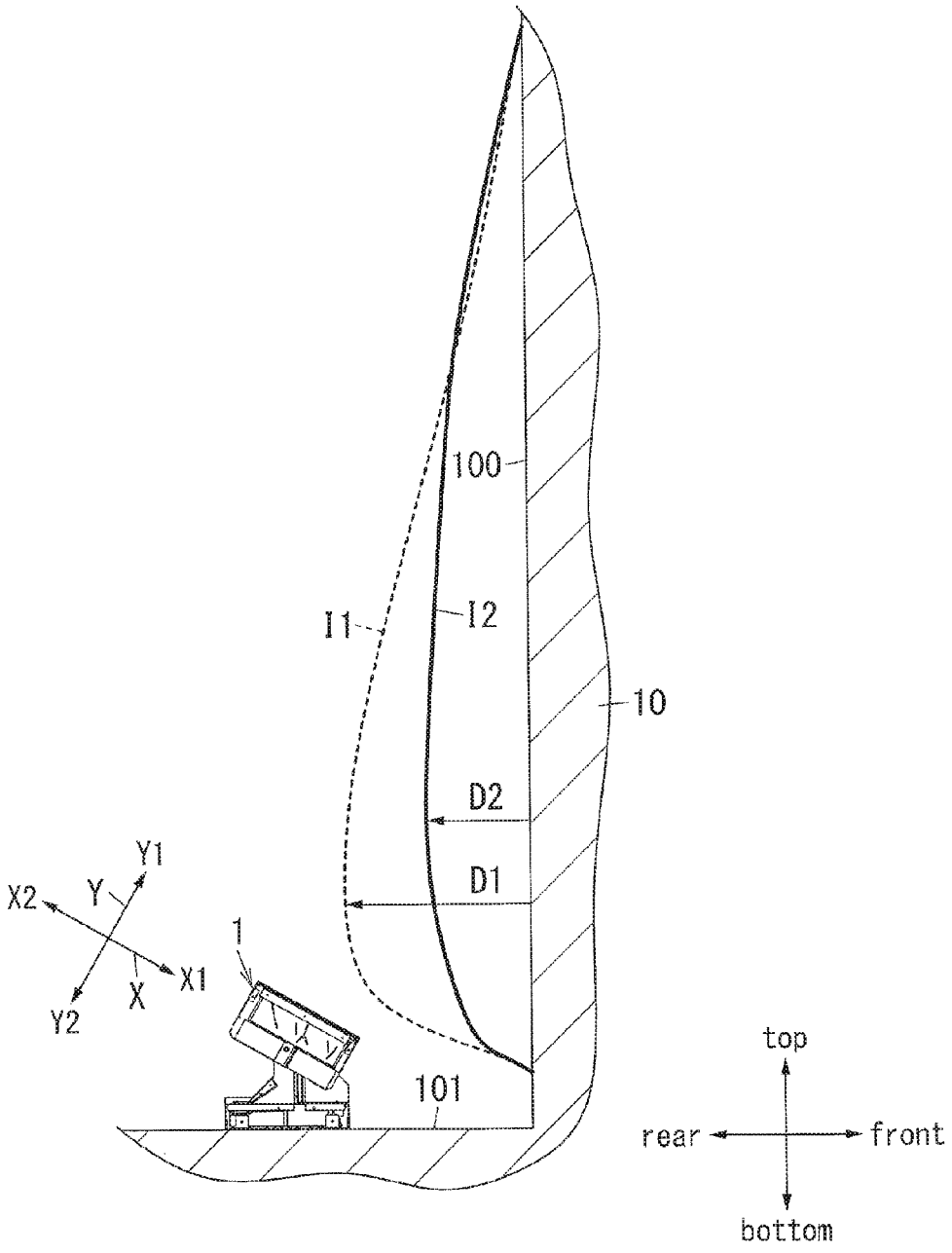
FIG. 7 is a layout view of a usage example of the lighting device.

Incidentally, the lighting device 1 of the present embodiment, as shown in FIG. 7, is installed on the floor 101 as an installation surface on which a wall surface (illuminated surface of the target 10) 100 is installed. The lighting device 1 is installed on the floor 101 so that the Y-axis direction, which is same as optical axes OA1 and OA2, crosses to a standing direction (the top-and-bottom direction) of the wall surface 100. In other words, the front-and-rear direction's distance between the second lighting source 42 and wall surface 100 is shorter than the front-and-rear direction's distance between the first lighting source 41 and the wall surface 100. Note that, the lighting device 1 may be installed at a predetermined location in the front-and-rear direction, and the angle of the optical axes OA1 and OA2 against the floor 101 may be changed by using knob bolts 63. The standing direction is a direction which is along to the illuminated surface and crossing to the installation surface of the lighting device 1. In other words, the standing direction is the direction which is along to the wall surface 100 and crossing to the floor 101 when the lighting device 1 is installed at the floor 101. Moreover, when the lighting device 1 is installed at the ceiling, the standing direction is a direction which is along to the wall surface 100 and crossing to the ceiling.

Note that, as shown in FIG. 7, a dashed line I1 represents an illumination curve I1 when a lighting device includes none of the first light adjustment panel 35, the second light adjustment panel 36, or the shielding panel 37 (a comparative example). A distance between the wall surface 100 and the illumination curve I1 represents an intensity of illuminance (an illuminance D1). As shown in FIG. 7, a solid line I2 represents an illumination curve I2 when the lighting device 1 includes the first light adjustment panel 35, the second light adjustment panel 36, and the shielding panel 37 (the lighting device 1 of the present embodiment). The distance between the wall surface 100 and the illumination curve I2 represents an intensity of illuminance (an illuminance D2).

Figure 8:
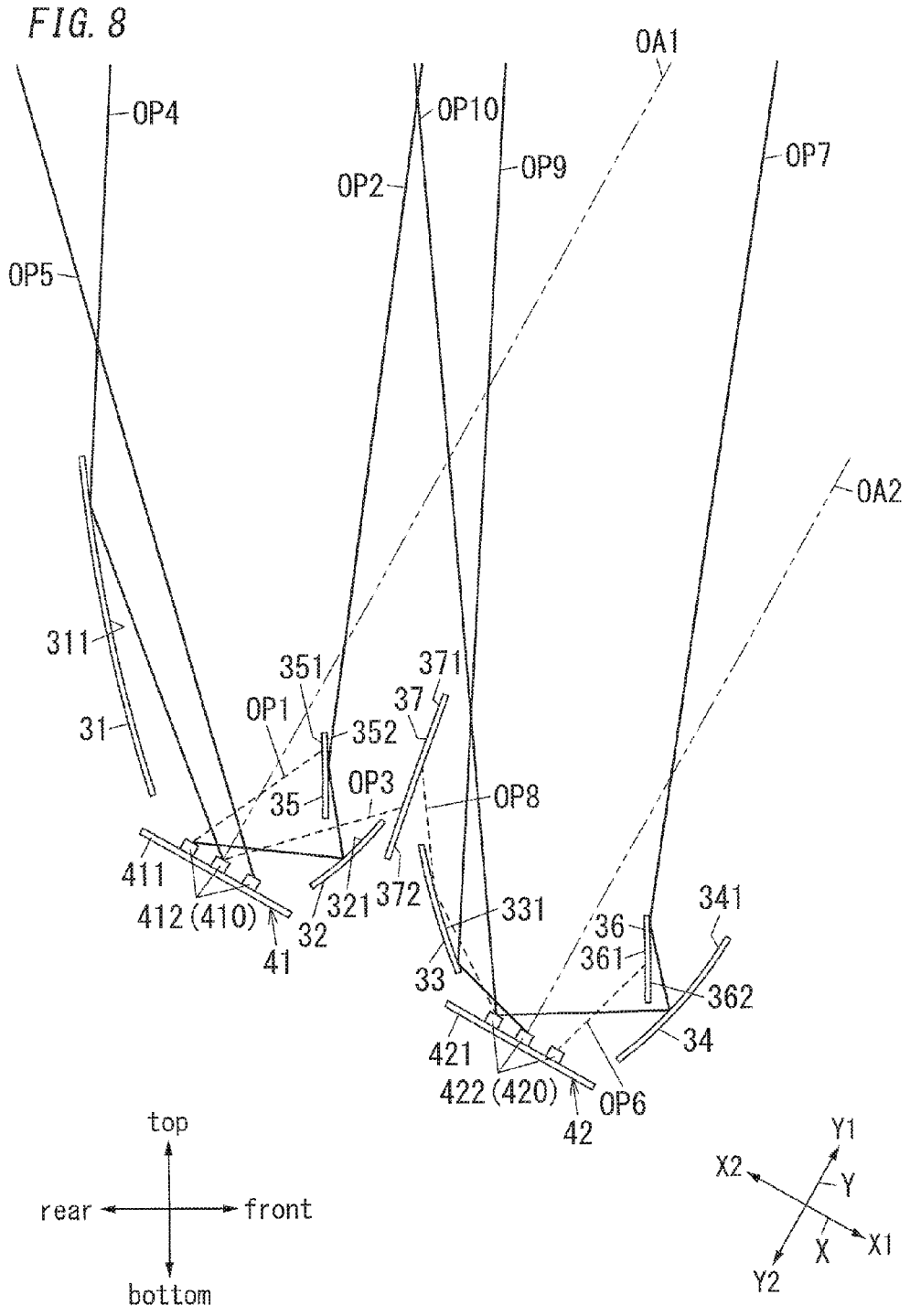
FIG. 8 is a schematic view of a path of light from the lighting source of the lighting device.
Figure 9:
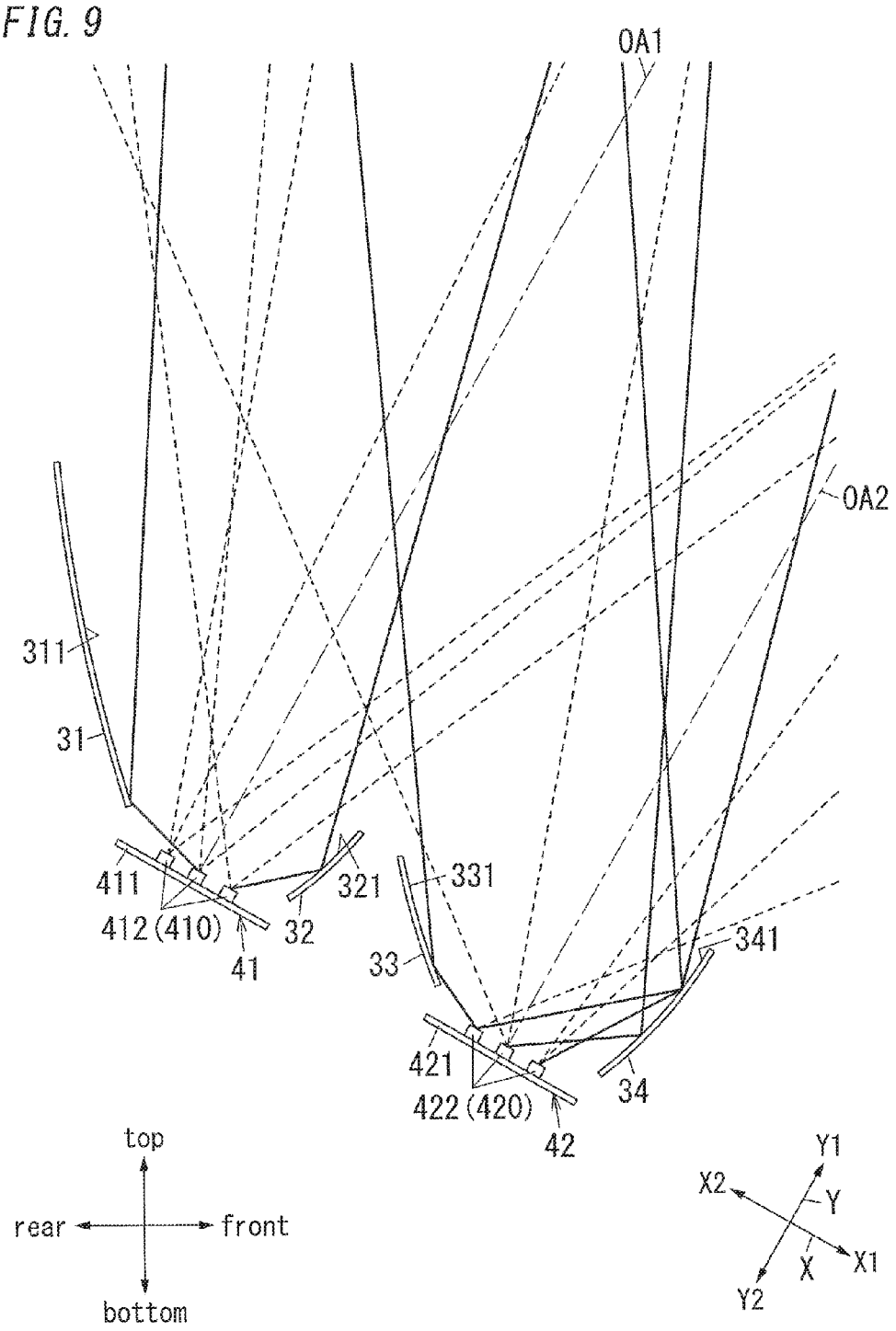
FIG. 9 is a schematic view of a path of light from a lighting source of a comparative example.

Here, paths of the light emitted from the first lighting source 41 and the second lighting source 42 are described. FIG. 8 shows the paths of the light (of the present embodiment) when the lighting device 1 includes the first light adjustment panel 35, the second light adjustment panel 36, and the shielding panel 37. As shown in FIG. 8, the shielding surface 351 of the first light adjustment panel 35 and the shielding surface 361 of the second light adjustment panel 36 are formed to have a low reflectance and absorb the light emitted from the lighting source 4. Besides, the shielding surface 352 of the first light adjustment panel 35 and the shielding surface 362 of the second light adjustment panel 36 are formed to have a high reflectance and reflect the light emitted from the lighting source 4. FIG. 9 shows paths of the light (of the comparative example) when the lighting device includes none of the first light adjustment panel 35, the second light adjustment panel 36, or the shielding panel 37. As shown in FIG. 8 and FIG. 9, the optical axis OA1 shows an optical axis of the lighting part 410 of the first lighting source 41, and the optical axis OA2 shows an optical axis of the lighting part 420 of the second lighting source 42.

As shown in FIG. 8, along an optical path OP1, the light traveled to the direction inclining upward and pointing to the first light adjustment panel 35 from the LEDs 412 of the first lighting source 41 hits the shielding surface 351 of the first light adjustment panel 35, and is shielded. Along an optical path OP2, the light traveled to the front direction from the LEDs 412 of the first lighting source 41 is reflected by the reflection surface 321 of the second reflection panel 32, reflected by the shielding surface 352 of the first light adjustment panel 35, and travels toward the first panel 22. Along an optical path OP3, the light traveled to the direction inclining frontward and pointing to the shielding panel 37 from the LEDs 412 of the first lighting source 41 is shielded by the shielding surface 371 of the shielding panel 37.

Along an optical path OP4, the light traveled to the direction inclining rearward and pointing to the first reflection panel 31 from the LEDs 412 of the first lighting source 41 is reflected by the reflection surface 311 of the first reflection panel 31 and travels toward the first panel 22. Along an optical path OP5, the light traveled to the direction inclining upward from the LEDs 412 of the first lighting source 41 travels upward.

Along an optical path OP6, the light traveled to the direction inclining upward and pointing to the second light adjustment panel 36 from the LEDs 422 of the second lighting source 42 hits the shielding surface 361 of the second light adjustment panel 36, and is shielded. Along an optical path OP7, the light traveled to the front direction from the LEDs 422 of the second lighting source 42 is reflected by the reflection surface 341 of the fourth reflection panel 34, reflected by the shielding surface 362 of the second light adjustment panel 36, and travels toward the first panel 22. Along an optical path OP8, the light traveled to the direction inclining upward and pointing to the third reflection panel 33 from the LEDs 422 of the second lighting source 42 is reflected by the reflection surface 331 of the third reflection panel 33, and shielded by the shielding surface 372 of the shielding panel 37. Along an optical path OP9, the light traveled to the direction inclining rearward and pointing to the third reflection panel 33 from the LEDs 422 of the second lighting source 42 is reflected by the reflection surface 331 of the third reflection panel 33 and travels toward the first panel 22. Along an optical path OP10, the light traveled upward from the LEDs 422 of the second lighting source 42 travels upward.

In a comparative example as shown in FIG. 9, comparing with the paths of the light as shown in FIG. 8, there exist more optical paths of the light emitted to the front side of the optical axes OA1 and OA2 from plural LEDs 412 of the first lighting source 41. Besides, the intensity of an illumination at a place closer to the first lighting source 41 of the wall surface 100 is stronger by the light emitted from the first lighting source 41. Moreover, in the comparative example, comparing with the paths of the light as shown in FIG. 8, there exist more the optical paths of the light emitted to front side of the optical axis OA2 from the plural LEDs 422 of the second lighting source 42. Further, the intensity of an illumination at a place closer to the second lighting source 42 of the wall surface 100 is stronger by the light emitted from the second lighting source 42. In other words, as the illumination curve I1 of the wall surface 100 by the first lighting source 41 and the second lighting source 42 in the comparative example, the intensity of an illumination D1 at a lower part of the wall surface 100 is more likely to be stronger and the intensity of an illumination D1 at higher part of the wall surface 100 is more likely to be weaker (refer to FIG. 7).

Accordingly, in the lighting device 1 of the present embodiment, the shielding surface 351 of the first light adjustment panel 35, as shown in FIG. 8, shields a part of the light emitted from the plural LEDs 412 of the first lighting source 41 to the front side (the first end side) of the optical axis OA1. The shielding surface 361 of the second light adjustment panel 36 shields a part of the light emitted from the plural LEDs 422 of the second lighting source 42 to the front side (the first end side) of the optical axis OA2. Besides, the shielding surfaces 371 and 372 of the shielding panel 37 shield a part of the light emitted to a lower part of the wall surface 100.

Moreover, the shielding surface 352 of the first light adjustment panel 35 and the shielding surface 362 of the second light adjustment panel 36 reflect a part of the light emitted from the first lighting source 41 and the second lighting source 42, and thus, when the lighting device 1 emits the light to the wall surface 100, an irregular illumination on the wall surface 100 can be reduced. In other words, the shielding surface 352 of the first light adjustment panel 35 and the shielding surface 362 of the second light adjustment panel 36 are configured to reflect a part of the light emitted from the first lighting source 41 and the second lighting source 42. A part of the light to illuminating the wall surface is reflected by the shielding surface 352 of the first light adjustment panel 35 and the shielding surface 362 of the second light adjustment panel 36. Therefore, an irregular illumination of the wall surface 100 can be reduced.

As shown in the illumination curve I2 of the lighting device 1 of the present embodiment, the intensity of the illumination D2 of a lower side of the wall surface 100 (floor 101 side) is reduced by the shielding surface 351 of the first light adjustment panel 35, the shielding surface 361 of the second light adjustment panel 36, and the shielding panel 37. Besides, the lighting device 1 emits light to the wall surface 100 so that an illuminance distribution of the wall surface 100 in the top-and-bottom direction is more uniform by the shielding surface 352 of the first light adjustment panel 35 and the shielding surface 362 of the second light adjustment panel 36. In other words, the intensity of the illumination D2 of the light emitted to the wall surface 100 becomes more uniform with the shielding surface 352 of the first light adjustment panel 35 and the shielding surface 362 of the second light adjustment panel 36. Moreover, using the knob bolts 63, the angle of the case 2 can be changed and the lighting device 1 is able to emit light in the top-and-bottom direction to a far place of the wall surface 100, even if the lighting device 1 may be installed at a place different from the installation place shown in FIG. 7 in the front-and-rear direction.

Note that, the lighting device 1 of the present embodiment may be installed at a ceiling instead of the floor 101 by, for example, being suspended. The lighting source 4 may include only one first lighting source 41 and only one second lighting source 42. Further, the lighting source 4 may include three or more first lighting sources 41 and three or more second lighting sources 42. Besides, shapes and constitutions of the circuit board 411 of the first lighting source 41 and the circuit board 421 of the second lighting source 42 are not limited to those of the present embodiment.

Widths of the top-and-bottom direction, shapes, and inclination angles of the first reflection panel 31, the second reflection panel 32, the third reflection panel 33, and the fourth reflection panel 34 are not limited to those of the present embodiment. Also, widths of the top-and-bottom direction, shapes, and inclination angles of the first light adjustment panel 35, the second light adjustment panel 36, and the shielding panel 37 are not limited to those of the present embodiment.

The manner of settings of the reflectance of the shielding surfaces 351 and 352 of the first light adjustment panel 35 and the shielding surface 361 and 362 of the second light adjustment panel 36 are not limited to the manners of setting of the reflectance of the present embodiment. The lighting device 1 preferably includes the first light adjustment panel 35 in which the reflectance of the shielding surfaces 351 and 352 are set appropriately in accordance with a place and an environment of the installation. The lighting device 1 preferably includes the second light adjustment panel 36 in which the reflectance of the shielding surfaces 361 and 362 are adjusted appropriately in accordance with a place and an environment of the installation. The reflectance of the shielding surfaces 351 and 352 of the first light adjustment panel 35 and the shielding surfaces 361 and 362 of the second light adjustment panel 36 are not only adjusted by color of surfaces, but may be adjusted by processing the surfaces, such as a mirror surface processing. In additionally, the reflectance of the shielding surfaces 351 and 352 of the first light adjustment panel 35 and the shielding surfaces 361 and 362 of the second light adjustment panel 36 may be adjusted by processing the surfaces, such as a mirror surface processing, instead of being adjusted by color of surfaces.

The manners of adjustment of the reflectance of the shielding surfaces 371 and 372 of the shielding panel 37 are not limited to the manners of adjustment of the reflectance of the present embodiment. The lighting device 1 preferably includes the shielding panel 37 in which the reflectance of the shielding surfaces 371 and 372 are adjusted appropriately in accordance with a place and an environment of the installation. The reflectance of the shielding surfaces 371 and 372 of the shielding panel 37 are not only adjusted by color of surfaces, but may be adjusted by processing the surfaces, such as a mirror surface processing. In additionally, the reflectance of the shielding surfaces 371 and 372 of the shielding panel 37 may be adjusted by processing the surfaces, such as a mirror surface processing, instead of being adjusted by color of surfaces.

The materials and shapes of the heat sinks 5 are not limited to those of the present embodiment.

The lighting device 1 of the present embodiment emits light to the illuminated surface (wall surface 100) of the target 10 standing at the installation surface (floor 101) on which the lighting device 1 is installed. The lighting device 1 includes: the lighting source 4; the case 2 containing the lighting source 4; and the light adjuster 3 contained in the case 2 and adjusting a path of light emitted from the lighting source 4. The lighting source 4 includes the first lighting source 41 and the second lighting source 42 aligned along the predetermined direction (X direction) in the case 2. The second lighting source 42 is placed at a side of the first lighting source 41 at the predetermined side (X 1 side) of the predetermined direction (X direction). The light adjuster 3 includes the first reflection panel 31 and the second reflection panel 32 reflecting light emitted from the first lighting source 41, and the third reflection panel 33 and the fourth reflection panel 34 reflecting light emitted from the second lighting source 42. The light adjuster 3 further includes the first light adjustment panel 35 placed between the first reflection panel 31 and the second reflection panel 32, and the second light adjustment panel 36 placed between the third reflection panel 33 and the fourth reflection panel 34. Each of the reflection surface 311 of the first reflection panel 31 and the reflection surface 321 of the second reflection panel 32 are located facing each other in the predetermined direction (X direction). Each of the reflection surface 331 of the third reflection panel 33 and the reflection surface 341 of the fourth reflection panel 34 are located facing each other in the predetermined direction (X direction). The first light adjustment panel 35 is placed between the reflection surface 311 of the first reflection panel 31 and the reflection surface 321 of the second reflection panel 32, and shields a part of the light emitted from the first lighting source 41 to the predetermined side (front side) of an optical axis OA1 of the first lighting source 41. The second light adjustment panel 36 is placed between the reflection surface 331 of the third reflection panel 33 and the reflection surface 341 of the fourth reflection panel 34, and shields a part of the light emitted from the second lighting source 42 to the predetermined side of an optical axis OA2 of the second lighting source 42.

In other words, the lighting device 1 of the present embodiment emits light to the illuminated surface (wall surface) 100 of the target 10 standing at the installation surface (floor) 101 on which the lighting device 1 is installed. The lighting device 1 includes: the lighting source 4; the case 2 accommodating the lighting source 4; and the light adjuster 3 accommodated in the case 2 and adjusting a path of light emitted from the lighting source 4. The lighting source 4 includes the first lighting source 41 and the second lighting source 42 aligned along the predetermined direction (X-axis direction) in the case 2. The predetermined direction is the direction toward the second end of the case 2 from the first end of the case 2, and the first end (the first direction) X1 side is a side closer to the first end than the second end. The second lighting source 42 is placed at the first end (the first direction) X1 side of the first lighting source 41 in the predetermined direction (X-axis direction). The light adjuster 3 includes the first reflection panel 31 and the second reflection panel 32 both reflecting light emitted from the first lighting source 41, and the third reflection panel 33 and the fourth reflection panel 34 both reflecting light emitted from the second lighting source 42. The light adjuster 3 further includes the first light adjustment panel 35 placed between the first reflection panel 31 and the second reflection panel 32, and the second light adjustment panel 36 placed between the third reflection panel 33 and the fourth reflection panel 34. The reflection surface 311 of the first reflection panel 31 and the reflection surface 321 of the second reflection panel 32 face each other in the predetermined direction (X-axis direction). The reflection surface 331 of the third reflection panel 33 and the reflection surface 341 of the fourth reflection panel 34 face each other in the predetermined direction (X-axis direction). The first light adjustment panel 35 is placed between the reflection surface 311 of the first reflection panel 31 and the reflection surface 321 of the second reflection panel 32, and shields a part of the light, which is emitted from the first lighting source 41 to the first end (the first direction) X1 side of the optical axis OA1 of the first lighting source 41. The second light adjustment panel 36 is placed between the reflection surface 331 of the third reflection panel 33 and the reflection surface 341 of the fourth reflection panel 34, and shields a part of the light, which is emitted from the second lighting source 42 to the first end (the first direction) X1 side of the optical axis OA2 of the second lighting source 42.

The lighting device 1 of the present embodiment is configured as described above, and therefore an irregular illumination to the illuminated surface (wall surface) 100 of the target 10 can be reduced.

In the lighting device 1 of the present embodiment, both surfaces of the first light adjustment panel 35 preferably are shielding surfaces 351 and 352 to shield light. Both surfaces of the second light adjustment panel 36 preferably are shielding surfaces 361 and 362 to shield light.

When the lighting device 1 of the present embodiment is configured as described above, the lighting device 1 can reduce the irregular illumination in the wall surface 100 while decreasing the light emitted to the part of the wall surface 100 closer to the floor 101.

In the lighting device 1 of the present embodiment, the first light adjustment panel 35 is preferably placed so that the first surface (shielding surface) 351 faces to the first lighting source 41. The first surface 351 of the first light adjustment panel 35 is preferably a light absorbing surface having the higher absorptance than the second surface (shielding surface) 352, which is opposite to the first surface, of the first light adjustment panel 35. The second surface 352 of the first light adjustment panel 35 is preferably the light reflecting surface having the higher reflectance than the first surface 351 of the first light adjustment panel 35. The second light adjustment panel 36 is preferably placed so that the first surface (shielding surface) 361 faces to the second lighting source 42. The first surface 361 of the second light adjustment panel 36 is the light absorbing surface having the higher absorptance than the second surface (shielding surface) 362, which is opposite to the first surface, of the second light adjustment panel 36. The second surface 362 of the second light adjustment panel 36 is preferably the light reflecting surface having the higher reflectance than the first surface 361 of the second light adjustment panel 36.

The lighting device 1 of the present embodiment preferably further includes the shielding panel 37 placed between the second reflection panel 32 and the third reflection panel 33. Both surfaces of the surfaces of the shielding panel 37 are the shielding surfaces 371 and 372 to shield light.

When the lighting device 1 of the present embodiment is configured as described above, the lighting device 1 can decrease the light illuminating the part of the wall surface 100 closer to the floor 101.

In the lighting device 1 of the present embodiment, the predetermined direction (X direction) is preferably a direction that crosses to the standing-direction (top-and-bottom direction) of the target 10 (wall surface 100).

In other words, in the lighting device 1 of the present embodiment, the predetermined direction (X-axis direction) is preferably a direction that crosses to the standing-direction (top-and-bottom direction) of the target 10 which is a direction along to the illuminated surface (wall surface) 100 and crossing to the installation surface (floor) 101 when the lighting device 1 is installed at the installation surface (floor) 101.

When the lighting device 1 of the present embodiment is configured as described above, the lighting device 1 can reduce the irregular illuminations of the wall surface 100.

In the lighting device 1 of the present embodiment, each of the first lighting source 41 and the second lighting source 42 preferably includes plural LEDs 412 and 422 respectably.

When the lighting device 1 of the present embodiment is configured as described above, the lighting device 1 can emit the light with desired colors to the wall surface 100.

The lighting device 1 of the present embodiment preferable further includes the power source 611 for supplying electrical power to the lighting source 4, and the stand holder 6 containing the power source 611 and pivotally holding the case 2.

When the lighting device 1 of the present embodiment is configured as described above, the lighting device 1 can emits the light to the place far along to the wall surface 100 from the installed place.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

The invention claimed is:

1. A lighting device that emits light to an illuminated surface of a target standing at an installation surface on which the lighting device is installed, the lighting device comprising:

a lighting source;

a case accommodating the lighting source; and a light adjuster accommodated in the case and adjusting a path of light emitted from the lighting source, wherein:

the lighting source includes a first lighting source and a second lighting source aligned along a predetermined direction in the case, the predetermined direction being a direction toward a second end of the case from a first end of the case, and a first end side being a side closer to the first end than the second end, the second lighting source is placed at the first end side of the first lighting source in the predetermined direction, the light adjuster includes:

a first reflection panel and a second reflection panel, both reflecting light emitted from the first lighting source;

a third reflection panel and a fourth reflection panel, both reflecting light emitted from the second lighting source;

a first light adjustment panel placed between the first reflection panel and the second reflection panel; and a second light adjustment panel placed between the third reflection panel and the fourth reflection panel, a reflection surface of the first reflection panel and a reflection surface of the second reflection panel face each other in the predetermined direction, a reflection surface of the third reflection panel and a reflection surface of the fourth reflection panel face each other in the predetermined direction, the first light adjustment panel is placed between the reflection surface of the first reflection panel and the reflection surface of the second reflection panel, and shields a part of the light, which is emitted from the first lighting source to the first end side of an optical axis of the first lighting source, the second light adjustment panel is placed between the reflection surface of the third reflection panel and the reflection surface of the fourth reflection panel, and shields a part of the light, which is emitted from the second lighting source to the first end side of an optical axis of the second lighting source, both surfaces of the first light adjustment panel are shielding surfaces to shield light, both surfaces of the second light adjustment panel are shielding surfaces to shield light the first light adjustment panel is placed so that a first surface faces to the first lighting source, the first surface of the first light adjustment panel is a light absorbing surface having a higher absorptance than a second surface, which is opposite to the first surface, of the first light adjustment panel, the second surface of the first light adjustment panel is a light reflecting surface having a higher reflectance than the first surface of the first light adjustment panel, the second light adjustment panel is placed so that a first surface faces to the second lighting source, the first surface of the second light adjustment panel is a light absorbing surface having a higher absorptance than a second surface, which is opposite to the first surface, of the second light adjustment panel, and the second surface of the second light adjustment panel is a light reflecting surface having a higher reflectance than the first surface of the second light adjustment panel.

2. The lighting device according to claim 1, further comprising a shielding panel placed between the second reflection panel and the third reflection panel, both surfaces of the shielding panel being shielding surfaces to shield light.

3. The lighting device according to claim 1, wherein the predetermined direction is a direction that crosses to a standing-direction of the target which is a direction along to the illuminated surface and crossing to the installation surface and crossing to the when the lighting device is installed at the installation surface.

4. The lighting device according to claim 1, wherein each of the first lighting source and the second lighting source includes plural LEDs.

5. The lighting device according to claim 1, further comprising:

a power source for supplying electrical power to the lighting source; and a stand holder containing the power source and pivotally holding the case.

* * * * *